US007445287B2

(12) United States Patent
Chou

(10) Patent No.: US 7,445,287 B2
(45) Date of Patent: Nov. 4, 2008

(54) SEAT DEVICE FOR A CHAIR

(76) Inventor: Kuo-Ching Chou, No.29-10, Nioujhuang, Shanhua Township, Tainan County 741 (TW)

( * ) Notice: Subject to any disclaimer, the term of this patent is extended or adjusted under 35 U.S.C. 154(b) by 147 days.

(21) Appl. No.: 11/458,765

(22) Filed: Jul. 20, 2006

(65) Prior Publication Data

US 2008/0018154 A1 Jan. 24, 2008

(51) Int. Cl.
*A47C 3/027* (2006.01)

(52) U.S. Cl. ..... 297/284.4; 297/284.7; 297/284.8; 297/284.2; 297/230.14; 297/353

(58) Field of Classification Search ..... 297/284.7, 297/284.4, 284.8, 284.2, 230.14, 353
See application file for complete search history.

(56) References Cited

U.S. PATENT DOCUMENTS 4,362,334 A * 12/1982 Ross et al. ..... 297/230.12
5,344,211 A * 9/1994 Adat et al. ..... 297/230.14
5,853,222 A * 12/1998 Roslund et al. ..... 297/353
7,104,604 B1 * 9/2006 Kang ..... 297/284.7

* cited by examiner

*Primary Examiner*—Laurie K Cranmer
(74) *Attorney, Agent, or Firm*—Alan Kamrath; Kamrath & Associates PA

(57) ABSTRACT

A seat device for a chair having a lumbar support or a seatback is provided. A lower portion of the lumbar support (or seatback) is formed as a shaft having an external teeth portion for positioning pin lugs of a base and fixed blocks. A movable block is joined with one of the fixed blocks. An elastic member is positioned between inner holes of the external teeth portion and an internal teeth portion of the movable block. The fixed blocks are secured by outer covers. A lifter is pivoted to the outer cover secured with the movable block. The lumbar support (or seatback) is separated into a plate including a ladder-type groove and sliders and a pad jointed with a board on the back having a latch member and sliding grooves. A pull bar extends from the board. The angle and height adjustable lumbar support (or seatback) is therefore achieved.

11 Claims, 9 Drawing Sheets

SEAT DEVICE FOR A CHAIR

BACKGROUND OF THE INVENTION

1. Field of the Invention

The present invention provides a seat device for a chair. More particularly, it is directed to a seat device having a lumbar support or a seatback with an easy and simple operation for achieving desired angle and height adjustment.

2. Related Art

Conventionally, various seats with different functions have been developed by the current industry to meet the needs of different consumers. The seats can be used in the required situations and for different purposes by the users. There is a default setup on the seat pad, lumbar support, and armrest of the seat as an ergonomic mechanism. Therefore, when the user sits on the seat, he can obtain expected comfort. However, the lumbar support can only move up-and-down. Therefore, if the user does not sit completely inside the seat, the lumbar support does not contact the body and cannot perform any function.

SUMMARY OF THE INVENTION

The present invention provides an improved chair according to the prior-art lumbar support (or seatback) assembly for comfortable contacting with human lumbar or back region. A user can simply operate a lumbar support (seatback) according to the present invention to set a desired angle and height. In other words, when the user sits on the chair, he can adjust the angle and height of the lumbar support (seatback) so as to be completely supported by the lumbar support (seatback) and to meet ergonomic requirements as well as obtain optimal comfort.

One aspect of the invention provides a seat device for a chair comprising a lumbar support formed as a shaft at a lower portion, with the shaft having an external teeth portion at one end for positioning pin lugs of a base and fixed blocks. A movable block having an internal teeth portion matching with the external teeth portion is joined with one of the fixed blocks by sliding. An elastic member is positioned between inner holes of the external teeth portion of the shaft and the internal teeth portion of the movable block. Two outer covers secure the fixed blocks. A lifter is pivoted to the outer cover secured with the movable block. Thus, the movable block is forced outwards by the elastic member, and the internal teeth portion is moved away from the external teeth portion when the lifter is pressed so as to adjust angle of the lumbar support. The movable block is forced inwards by the lifter, and the internal teeth portion engages with the external teeth portion again under resistive force when the lifter is returned to the original position so that the lumbar support has a stable position.

Another aspect of the invention provides a seat device for a chair comprising a lumbar support separated into a plate and a pad. The plate has a ladder-type groove formed on a front surface and sliders provided on a top edge adjacent both sides of the ladder-type groove. The pad is further jointed with a board on the back having a latch member and sliding grooves respectively corresponding to the ladder-type groove and sliders. A pull bar extends from the board. The height of the lumbar support is therefore, adjustable for meeting an ergonomic design and obtaining the best comfort.

These and other features and advantages of the present invention will be further understood and appreciated by those skilled in the art by reference to the following specification, claims, and appended drawings.

DETAILED DESCRIPTION OF PREFERRED EMBODIMENTS

Figure 1:
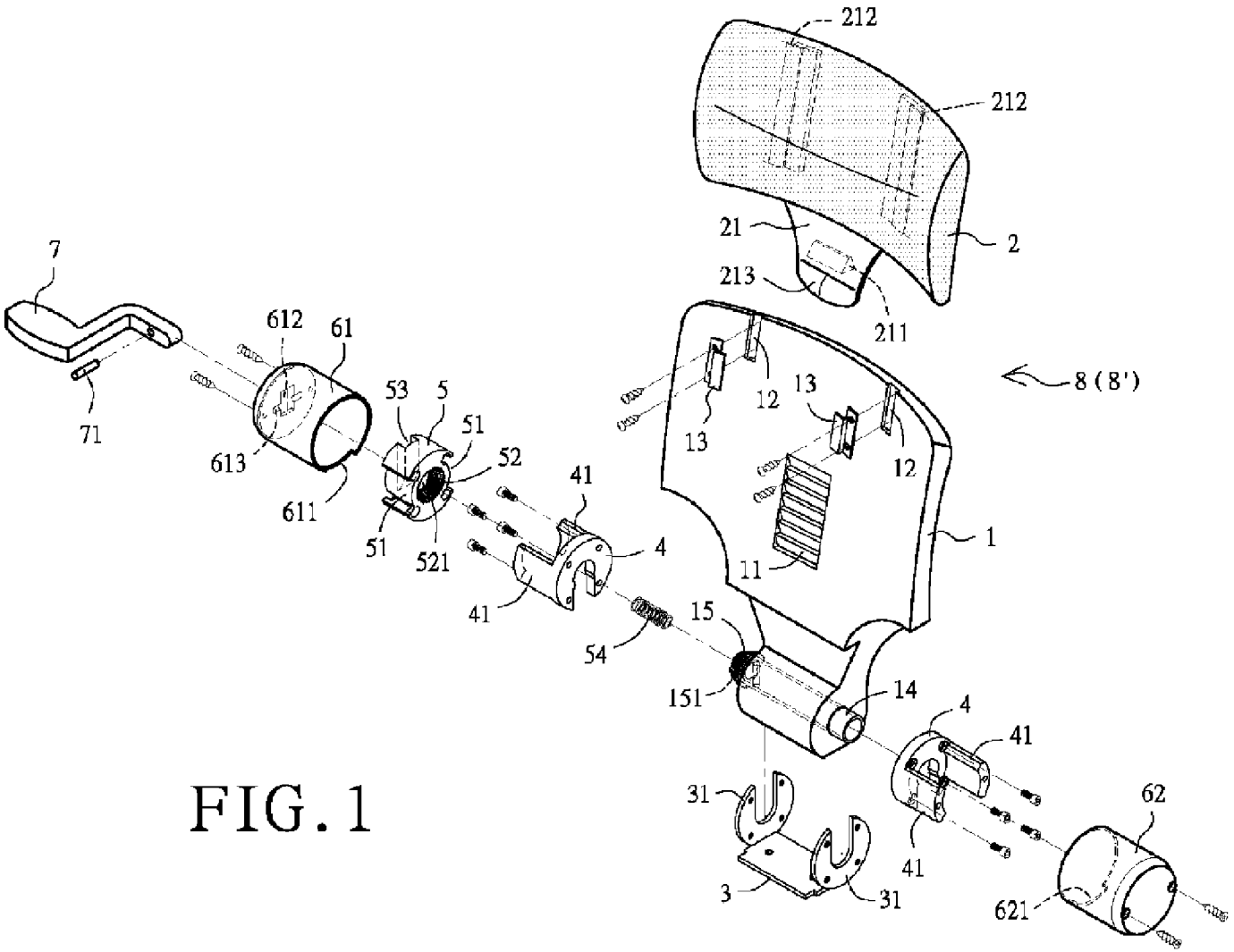
FIG. 1 is an exploded perspective view of a lumbar support (or seatback) according to the present invention.
Figure 2:
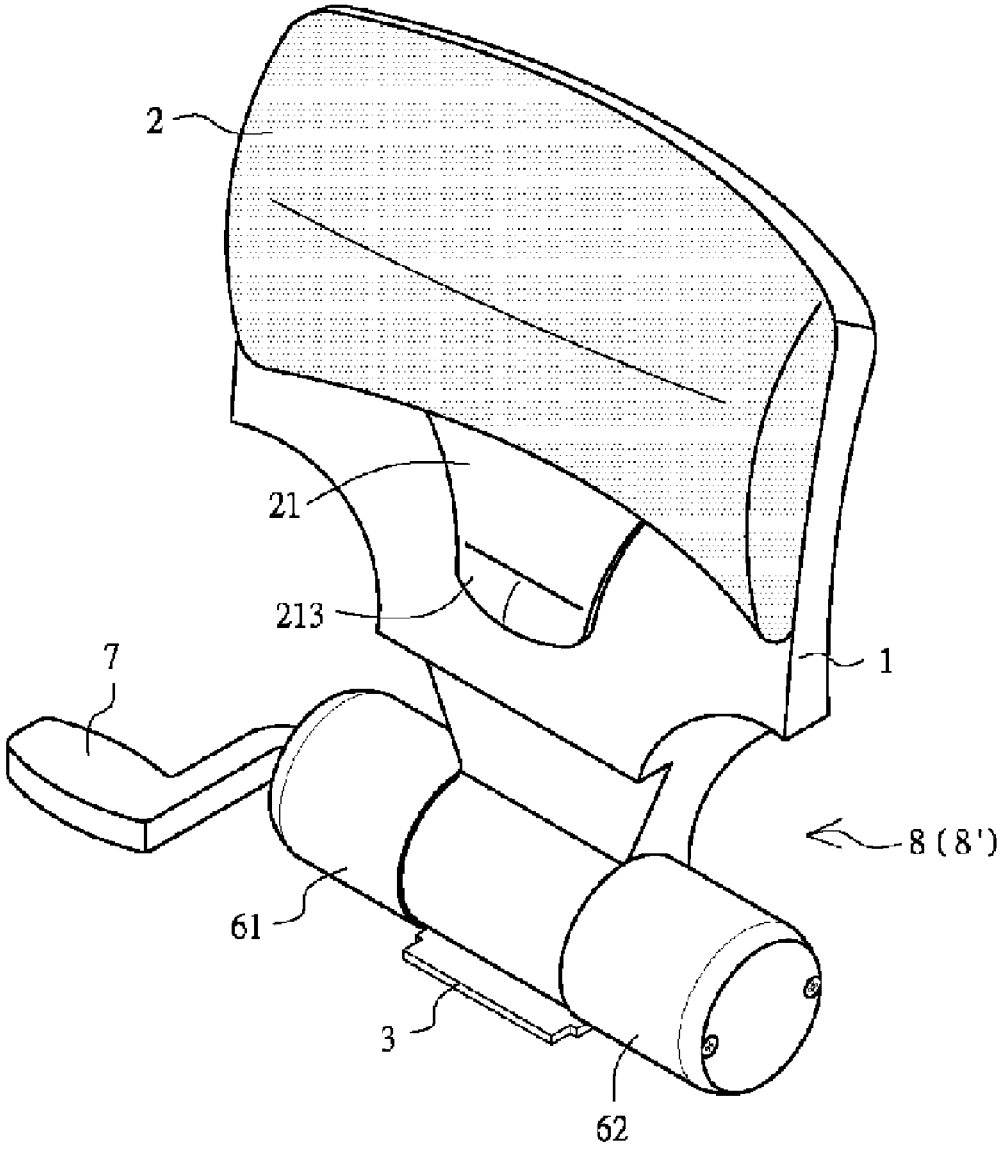
FIG. 2 is a perspective view of the lumbar support (or seatback) of FIG. 1 according to the present invention.

A seat device for a chair according to the present invention, referring to FIGS. 1 and 2, comprises a lumbar support 8 or a seatback 8'. The lumbar support 8 or seatback 8' is separated into a plate 1 and a pad 2 and comprises a base 3, fixed blocks 4, a movable block 5, an elastic member 54, outer covers 61 and 62, and a lifter 7.

Figure 9:
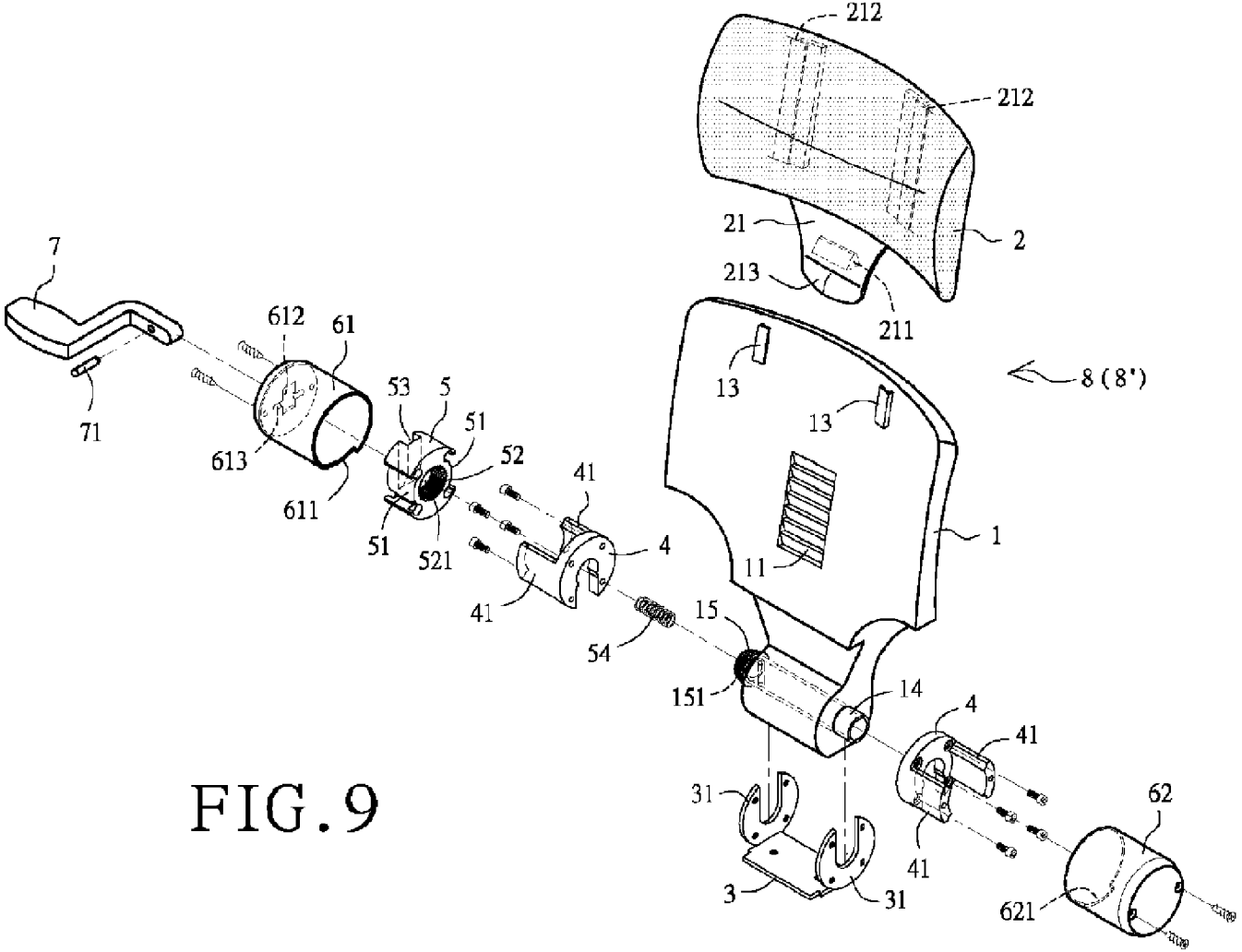
FIG. 9 is an alternative embodiment of the lumbar support (or seatback) according to the present invention.

A front surface of the plate 1 forms a ladder-type groove 11. Two grooves 12 are provided on a top edge of the front surface, each respectively adjacent either side of the ladder-type groove 11, for positioning sliders 13 with screws. Alternatively, the sliders 13 on the top edge of the front surface of the plate 1 are formed with the plate 1 integrally, as shown in FIG. 9, without providing the grooves 12. A lower portion of the plate 1 is formed as a shaft 14 having an external teeth portion 15 at one end with an internal hole 151 during plastic injection procedure. In a preferred embodiment, the lower portion of the plate 1 is formed as a hollow tube and embedded with a rod at one end.

The pad 2 is joined with a board 21 on a rear surface. The board 21 is formed with a latch member 211 and sliding grooves 212 respectively corresponding to the ladder-type groove 11 and the sliders 13 of the plate 1. A pull bar 213 extends from a lower end of the board 21.

The base 3 has two pin lugs 31, each having an upper opening and provided on either side of the base. The base 3 is joined with a seat of a chair 9 or 9'.

Each of the fixed blocks 4 has a down opening and two opposite extension sections 41 extending therefrom. Moreover, the fixed blocks 4 and the pin lugs 31 of the base 3, respectively have through-holes for securing by screws in a corresponding direction.

The movable block 5 has a length smaller than those of the extension sections 41 of the fixed block 4. The movable block 5 is formed with two opposite slots 51 having a width with respect to a width of the extension section 41 on the periphery. Further, the movable block 5 has an internal teeth portion 52 and an inner hole 521 at one end matching with the external teeth portion 15, and an arc groove 53 on the other end opposing the internal teeth portion 52.

Each of the outer covers 61 and 62 has a rim and a slot 611 or 621 on the rim. The outer cover 61 has a groove hole 612 on an outer face and a pivot groove 613 adjacent to the groove hole 612.

Figure 3C:
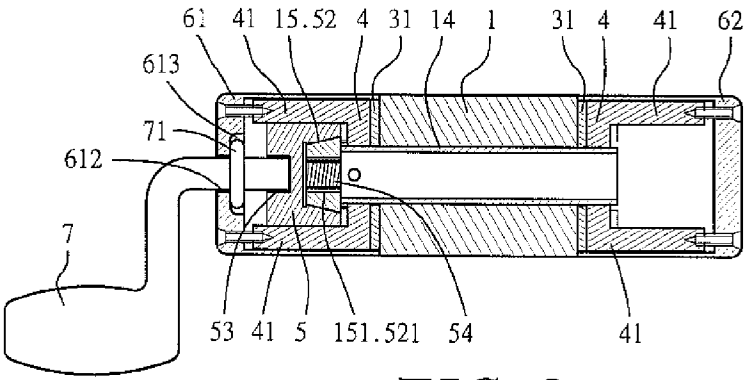
FIGS. 3*b* and 3*c* are cross-sectional views of the lumbar support (or seatback) of FIG. 3*a* according to the present invention.
Figure 3B:
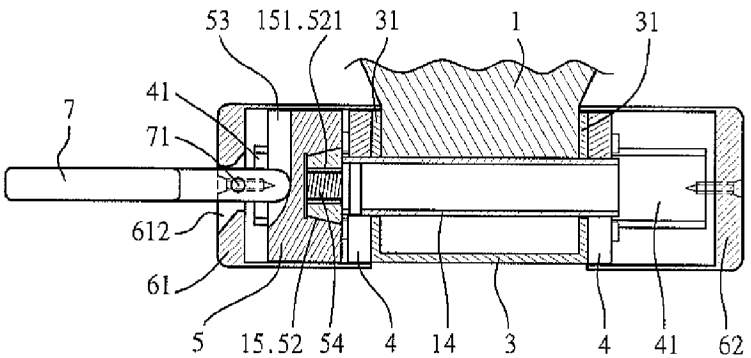
Figure 3A:
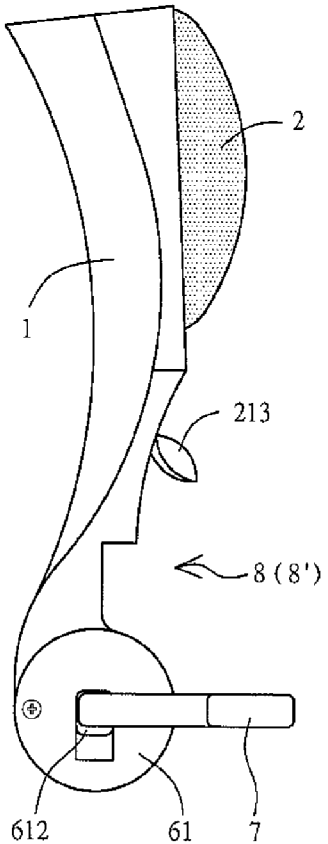
FIG. 3*a* is a side view of the lumbar support (or seatback) of FIG. 2 according to the present invention.
Figure 5B:
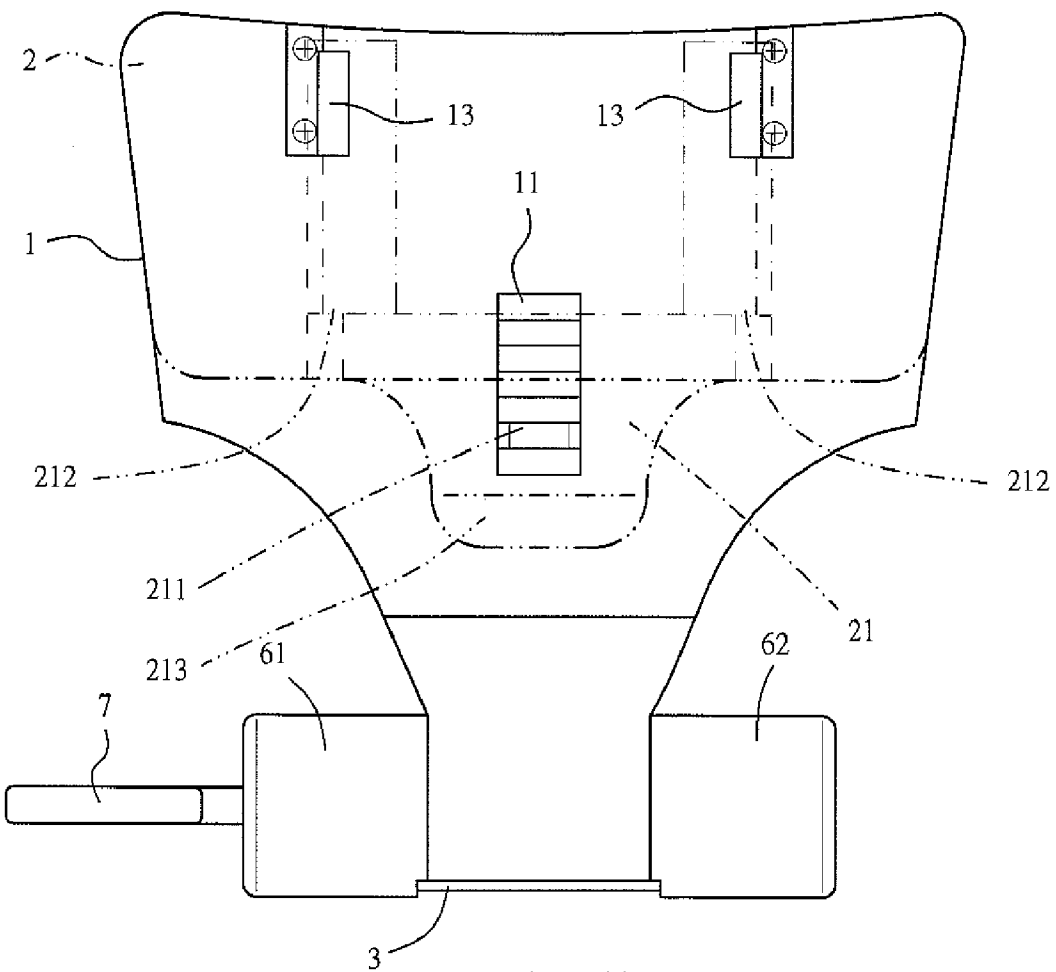
FIG. 5*b* is a front view of the lumbar support (or seatback) according to the present invention.
Figure 5A:
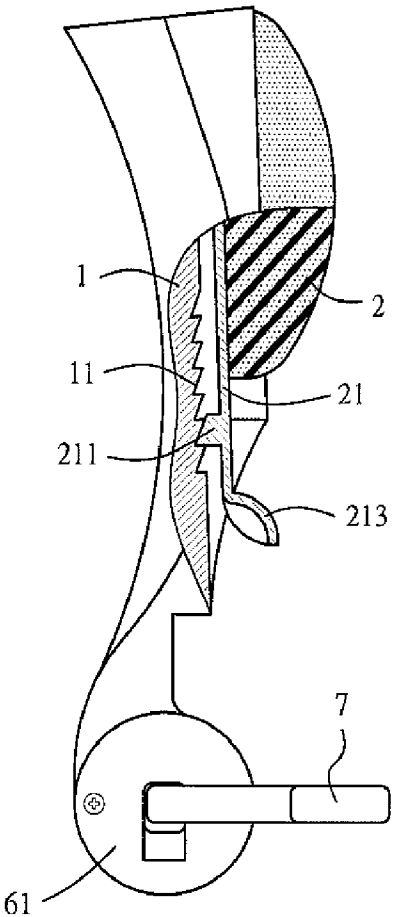
FIG. 5*a* is a side view of the lumbar support (or seatback) according to the present invention, with portions broken away.

Referring to FIGS. 1, 3, and 5, the assembly of the lumbar support 8 (or seatback 8') according to the preferred embodiment of the present invention is shown. The shaft 14 is first positioned between the pin lugs 31 of the base 3, and the fixed blocks 4 are mounted on the shaft 14. The opposite extension sections 41 of one of the fixed blocks 4 is slid into the opposite slots 51 of the movable block 5 so as to combine the movable blocks 5 to the one of the fixed blocks 4. Further, the elastic member 54 is positioned between the inner holes 151 and 521 of the external teeth portion 15 and internal teeth portion 52. The groove hole 612 and pivot groove 613 of the cover 61 are joined with the lifter 7 and a pivot bar 71. The outer covers 61 and 62 are screwed to the outsides of the two fixed blocks 4 for securing. The sliders 13 of the plate 1 are guided into the sliding grooves 212 of the board 21 of the pad 2 so that the latch member 211 of the board 21 is positioned in the ladder-type groove 11 of the plate 1.

Figure 4C:
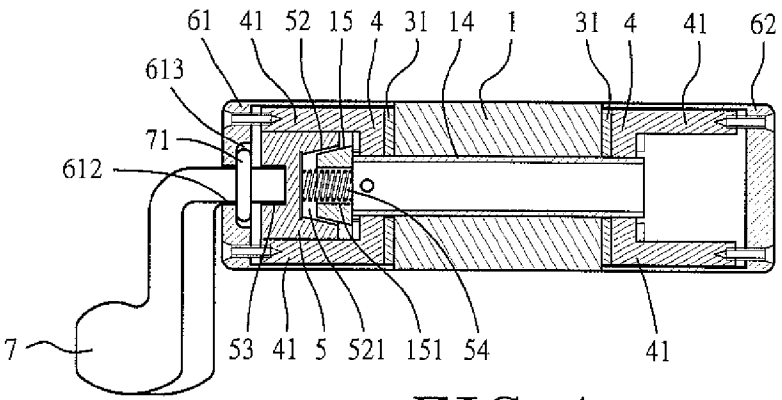
FIGS. 4*b* and 4*c* are cross-sectional views of the lumbar support (or seatback) of FIG. 4*a* according to the present invention.
Figure 4B:
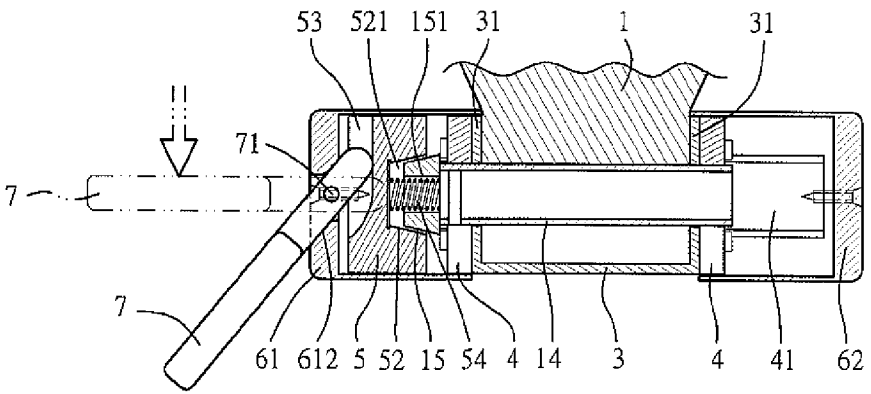
Figure 4A:
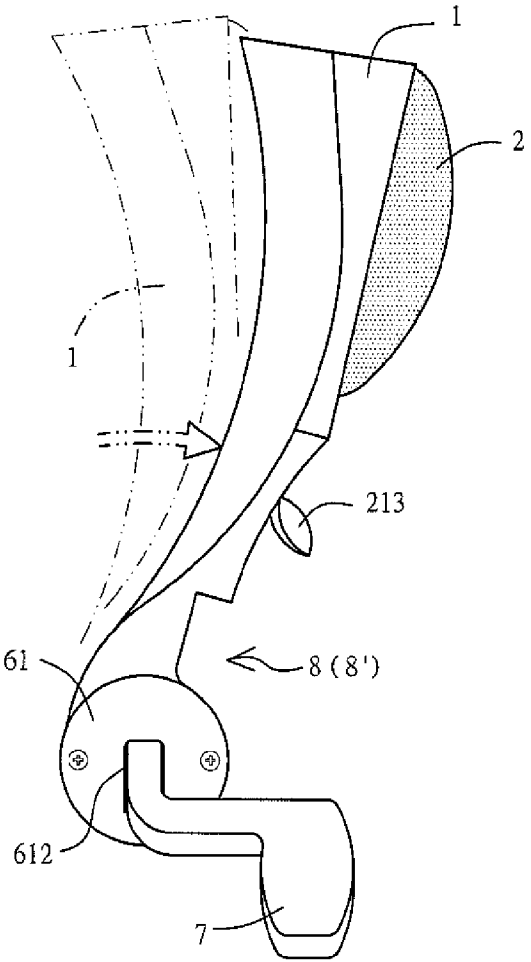
FIG. 4*a* is a side view of the lumbar support (or seatback) of FIG. 2 and illustrates an angle adjustment of the lumbar support (or seatback) according to the present invention.

To adjust the angle of the seat device, referring to FIGS. 3 and 4, operation of the angle adjustment of the lumbar support 8 (or seatback 8') is illustrated. When the lifter 7 is pressed, the movable block 5 is forced outwards by the elastic member 54 for moving the internal teeth portion 52 out of the external teeth portion 15. Thus, as shown in FIG. 4, the lumbar support 8 (or seatback 8') is adjustable to any angle. Therefore, the lumbar support 8 (or seatback 8') can completely contact with the human lumbar or back region for meeting an ergonomic design as well as obtaining the best comfort. When the lifter 7 returns to the original position, the movable block 5 is forced inwards by the lifter 7, and the internal teeth portion 52 engages with the external teeth portion 15 under a resistive force. As shown in FIG. 3, the lumbar support 8 (or seatback 8'), thus, has a stable positioning mechanism.

Figure 6B:
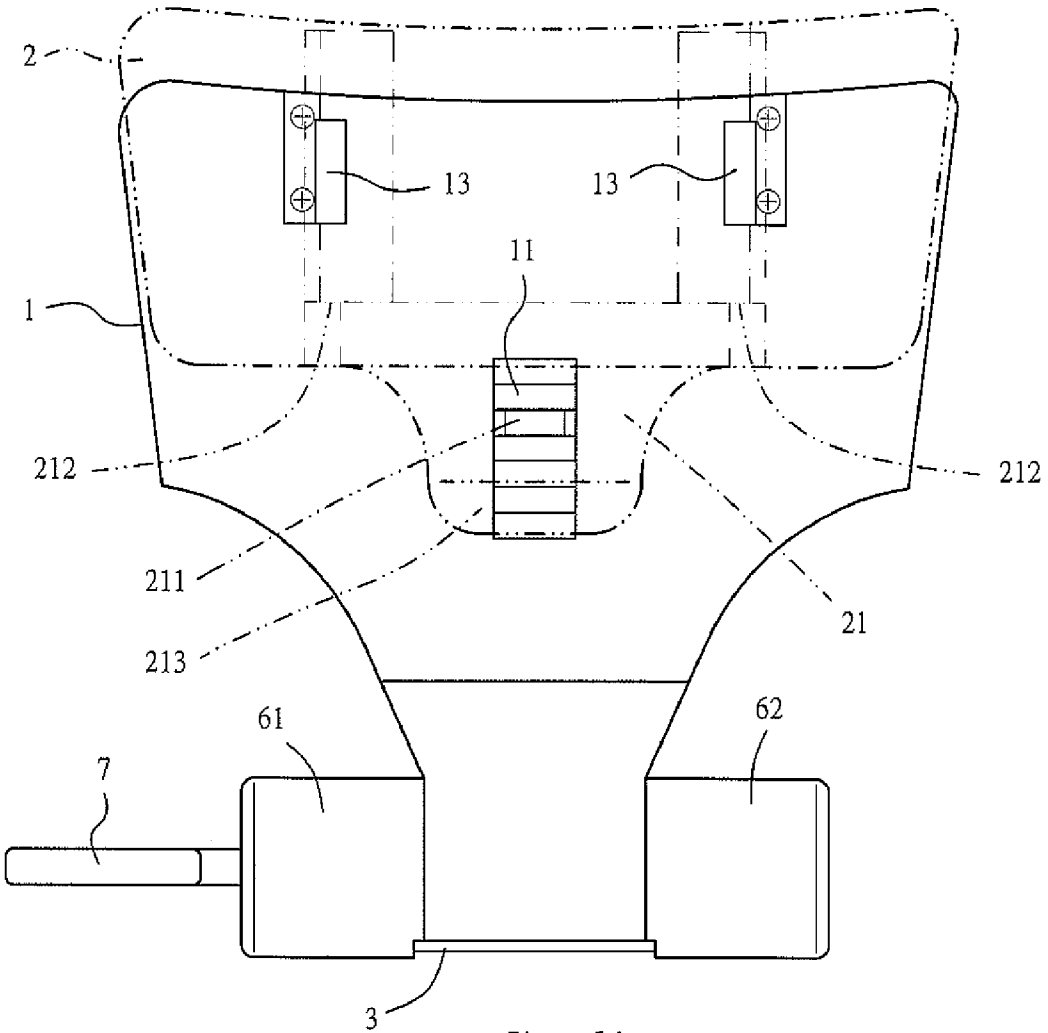
FIG. 6*b* is a front view of the lumbar support (or seatback) according to the present invention.
Figure 6A:
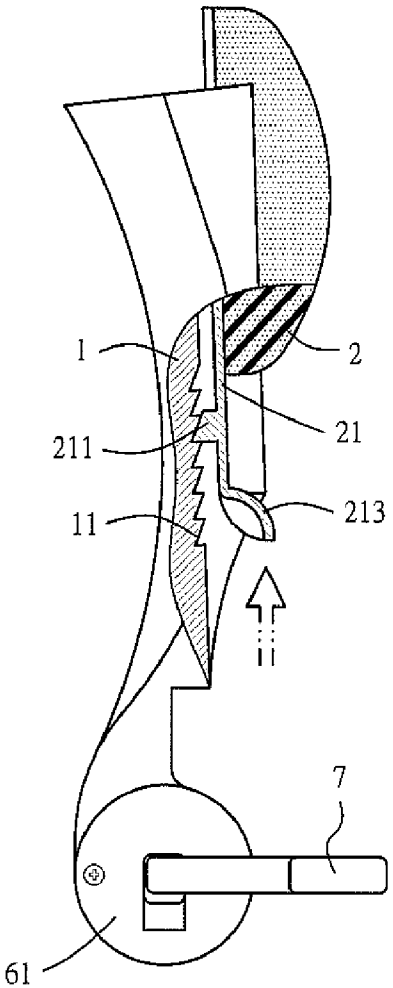
FIG. 6*a* is a side view of the lumbar support (or seatback) according to the present invention, with portions broken away, and illustrates a height adjustment of the lumbar support (or seatback) according to the present invention.

To adjust the height of the seat structure, referring to FIGS. 5 and 6, operation of the height adjustment of the seat device is illustrated. When the pull bar 213 extending from the end of the board 21 is pulled, the latch member 211 of the board 21 is out of the ladder-type groove 11 of the plate 1. The board 21 with the pad 2 moves up-and-down by cooperation of the sliding grooves 212 with the sliders 13 of the plate 1. When the pull bar 213 is released, the latch member 211 is limited by the ladder-type groove 11 of the plate 1 for setting the lumbar support 8 (or seatback 8') to a desired height under use as well as meeting an ergonomic design and obtaining a best comfort.

Figure 7:
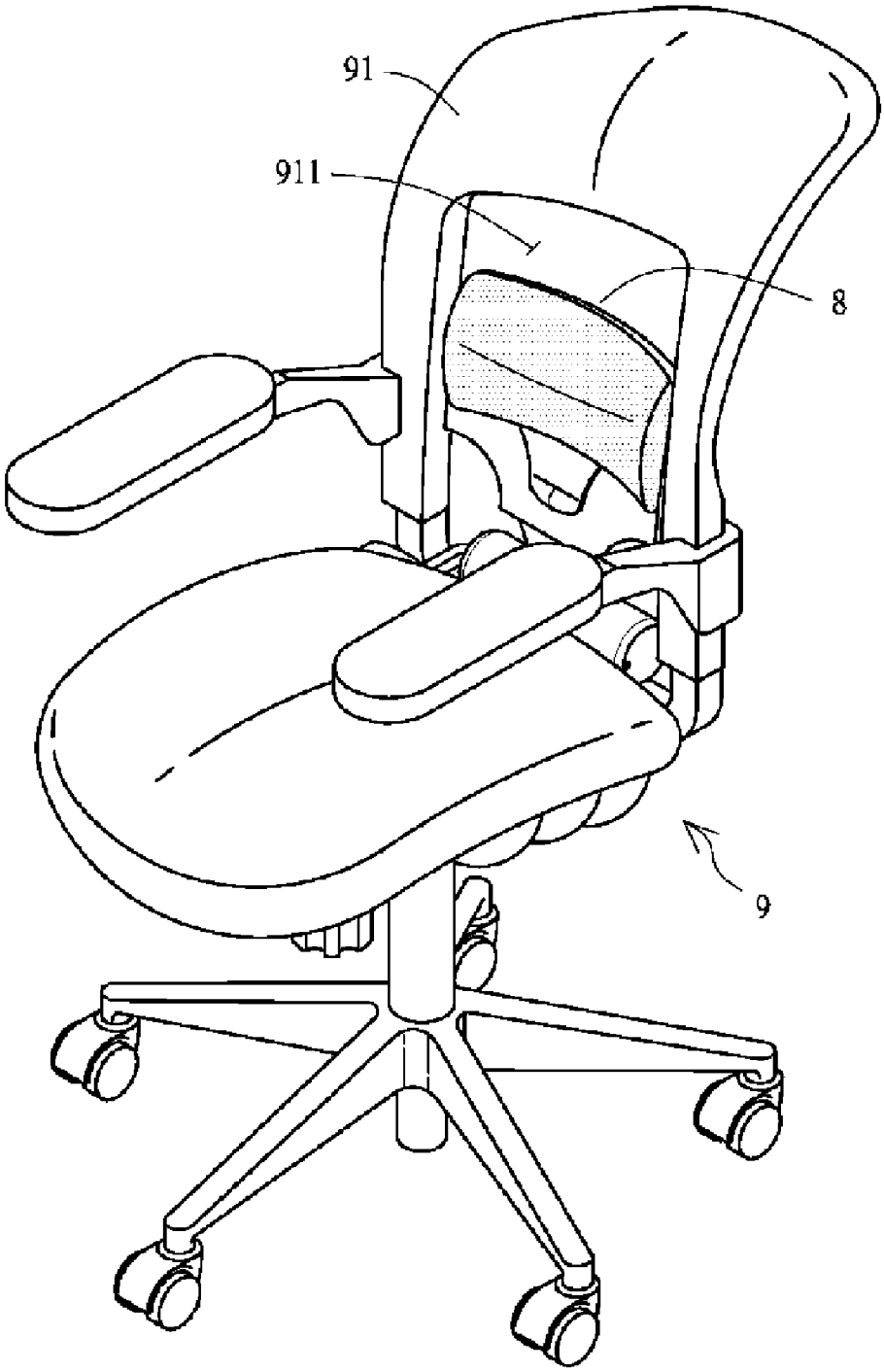
FIG. 7 shows the lumbar support according to the present invention employed in a seatback of a chair.

Referring to FIG. 7, the lumbar support 8 according to the present invention employed in a seatback 91 of the chair 9 is shown. The seatback 91 has an exposed space 911 at a default section so as to receive the lumbar support 8. When a user sits in the chair 9, the angle or height of the lumbar support 8 is adjustable by the user for completely contacting with the lumbar support 8 as well as meeting an ergonomic design and obtaining the best comfort.

Figure 8:
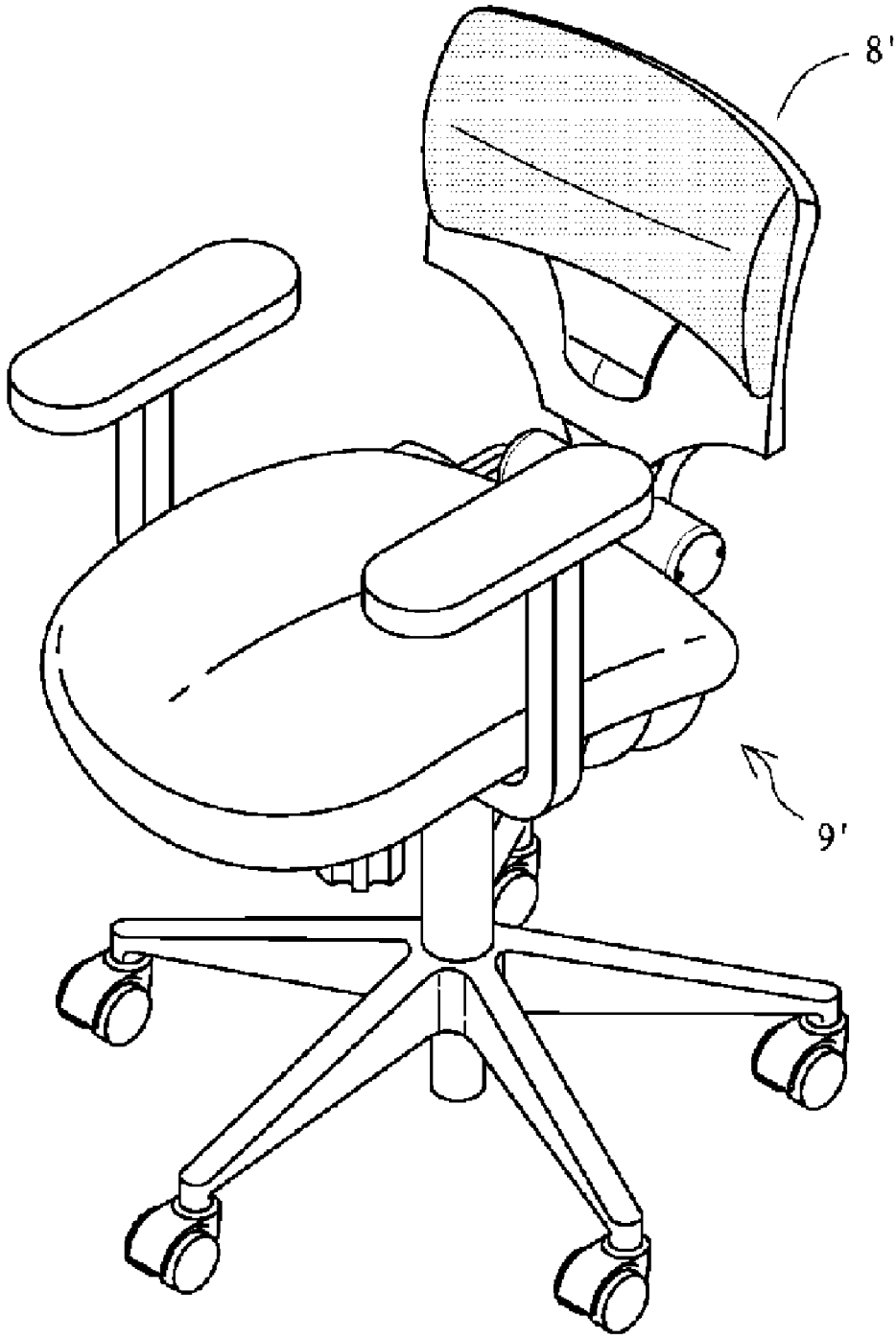
FIG. 8 shows the seatback of a chair according to the present invention.

Referring to FIG. 8, the seatback 8' according to the present invention joined with a seat of the chair 9' is shown. When the user sits on the chair 9', the angle or height of the seatback 8' is adjustable by the user for completely contacting with the seatback 8' as well as meeting ergonomics and obtaining the best comfort.

It is appreciated that the above description are preferred embodiments of the present invention, and do not limit the present invention. Any changes made to the concept of the present invention without departing from the spirit and scope of the present invention and other variations, modifications, applications, and equivalents, such as altering the formation or arranging models should be covered by the claims of the present invention.

What is claimed is:

1. A seat device for a chair comprising: an angle-adjustable lumbar support, with a lower portion of the lumbar support formed as a shaft for positioning pin lugs of a base and fixed blocks on the shaft, wherein the shaft has an external teeth portion at one end; a movable block having an internal teeth portion matching with the external teeth portion and joined with one of the fixed blocks by sliding; an elastic member positioned between inner holes of the external teeth portion of the shaft and the internal teeth portion of the movable block; two outer covers securing the fixed blocks; and a lifter pivoted to one of the two outer covers and secured with the movable block;

whereby the movable block is forced outwards by the elastic member and the internal teeth portion is moved away from the external teeth portion when the lifter is pressed from an original position so as to adjust an angle of the lumbar support; and the movable block is forced inwards by the lifter and the internal teeth portion engages with the external teeth portion again under resistive force when the lifter is returned to the original position so that the lumbar support has a stable position.

2. The seat device according to claim 1, wherein the lumbar support can be directly used as a seatback.

3. The seat device according to claim 2, wherein said shaft is in a form of a hollow tube embedded with a rod at one end.

4. The seat device according to claim 1, wherein said shaft is in a form of a hollow tube embedded with a rod at one end.

5. A seat device for a chair comprising: a height-adjustable lumbar support, wherein the lumbar support is separated into a plate and a pad; wherein the plate has a ladder-type groove formed on a front surface and first and second sliders extending from a top edge adjacent the ladder-type groove; wherein the pad is joined with a board, with the board having a latch member integrally formed with the board and corresponding to the ladder-type groove, with the board being flexible relative to the pad, with the board further having sliding grooves corresponding to and slideable with the first and second sliders; and a pull bar extends from the board;

whereby the latch member of the board is out of the ladder-type groove of the plate when the pull bar is pulled so as to make the board with the pad move up-and-down by cooperation of the sliding grooves with the first and second sliders; and the latch member is limited by restraint of the ladder-type groove of the plate when the pull bar is released so that the lumbar support is retained at a desired height.

6. The seat device according to claim 5, wherein the lumbar support can be directly used as a seatback.

7. The seat device according to claim 6, wherein the plate is provided with grooves receiving the first and second sliders, with the first and second sliders secured to the plate by screws.

8. The seat device according to claim 6, wherein the first and second sliders are formed integrally with the plate.

9. The seat device according to claim 5 wherein the plate includes first and second sides edges extending in a direction parallel to the ladder-type groove, with the ladder-type groove being spaced from and intermediate the first and second sliders, with the first and second sliders located spaced from and intermediate the ladder-type groove and the first and second side edges, with the board having first and side edges, with the sliding grooves located intermediate and spaced from the first and second side edges of the board.

10. The seat device according to claim 9, wherein the plate is provided with grooves receiving the first and second sliders, with the first and second sliders secured to the plate by screws.

11. The seat device according to claim 9, wherein the sliders are formed integrally with the plate.

* * * * *